US007420554B2

(12) United States Patent
Senda

(10) Patent No.: US 7,420,554 B2
(45) Date of Patent: Sep. 2, 2008

(54) DISPLAY AND SEMICONDUCTOR DEVICE

(75) Inventor: Michiru Senda, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 834 days.

(21) Appl. No.: 10/879,751

(22) Filed: Jun. 30, 2004

(65) Prior Publication Data

US 2004/0262653 A1 Dec. 30, 2004

(30) Foreign Application Priority Data

Jun. 30, 2003 (JP) ..... 2003-186413

(51) Int. Cl.
*G09G 5/00* (2006.01)

(52) U.S. Cl. ..... 345/214; 345/78; 345/94

(58) Field of Classification Search ..... 345/204–206, 345/208, 211–215, 690, 92, 94, 95, 78
See application file for complete search history.

(56) References Cited

U.S. PATENT DOCUMENTS

| | | | | |
|---|---|---|---|---|
| 6,670,935 | B2 | 12/2003 | Yeon et al. | |
| 6,937,222 | B2 | 8/2005 | Numao | |
| 6,940,214 | B1 * | 9/2005 | Komiya et al. | 313/51 |
| 7,038,644 | B2 * | 5/2006 | Kim et al. | 345/87 |
| 7,079,101 | B1 * | 7/2006 | Asada | 345/92 |

FOREIGN PATENT DOCUMENTS

| | | |
|---|---|---|
| JP | 2002-221949 A | 8/2002 |
| JP | 2003-114651 | 4/2003 |
| KR | 2002-62218 | 7/2002 |
| WO | WO 97/32297 | 9/1997 |

OTHER PUBLICATIONS

M. Yazaki et al., "Conduction Mechanism of Leakage Current Observed in Metal-Oxide-Semiconductor Transistors and Poly-Si Thin-Film Transistors", Jpn. J. Appl. Phys., vol. 31, (1992), pp. 206-209.

Office Action issued in corresponding Korean Application No. 10-2004-0049596, issued on Feb. 22, 2006.

European Search Report for Corresponding Application No. 04253928.8 dated Feb. 6, 2007.

* cited by examiner

*Primary Examiner*—Richard Hjerpe
*Assistant Examiner*—Tom V Sheng
(74) *Attorney, Agent, or Firm*—McDermott Will & Emery LLP

(57) ABSTRACT

A display capable of correctly displaying images with brightness in response to a video signal is provided. This display comprises a pixel including a p-type first field-effect transistor subjected to application of a first bias voltage in the period of an operation of holding a pixel potential and a pixel electrode. The display applies a second bias voltage larger than the first bias voltage to the p-type first field-effect transistor in a prescribed period other than the period for the operation of holding the pixel potential.

12 Claims, 6 Drawing Sheets

DISPLAY AND SEMICONDUCTOR DEVICE

BACKGROUND OF THE INVENTION

1. Field of the Invention

The present invention relates to a display and a semiconductor device, and more particularly, it relates to a display and a semiconductor device each including a p-type field-effect transistor.

CROSS-REFERENCE TO RELATED APPLICATIONS

The priority application number JP2003-186413 upon which this patent application is based is hereby incorporated by reference.

2. Description of the Background Art

A display such as a liquid crystal display or an organic EL display comprising a pixel including transistors is known in general, as disclosed in Japanese Patent Laying-Open No. 2003-114651 (IPC: G09G 3/36), for example.

FIG. 9 is a circuit diagram showing a pixel 102 of an exemplary conventional liquid crystal display. Referring to FIG. 9, the pixel 102 constituting the conventional liquid crystal display includes a transistor 102*a*, a pixel electrode 102*b*, a common electrode 102*c*, common to each pixel 102, arranged oppositely to the pixel electrode 102*b*, a liquid crystal 102*d* held between the pixel electrode 102*b* and the common electrode 102*c* and a storage capacitor 102*e*. One of the source and the drain of the transistor 102*a* is connected to a drain line. The other one of the source and the drain of the transistor 102*a* is connected to a first electrode of the storage capacitor 102*e* as well as to the pixel electrode 102*b* holding the liquid crystal 102*d* along with the common electrode 102*c*. The gate of this transistor 102*a* is connected to a gate line.

In general, an n-type MOS field-effect transistor is employed for constituting a pixel in a display such as the aforementioned liquid crystal display.

In operation, the conventional liquid crystal display shown in FIG. 9 turns on the transistor 102*a* and supplies a prescribed video signal to the drain line. Thus, the video signal is supplied to the pixel electrode 102*b* through the transistor 102*a*, thereby driving the liquid crystal 102*d*. At this time, the liquid crystal display charges the storage capacitor 102*e* with a voltage in response to the video signal. Thereafter the liquid crystal display applies a prescribed bias voltage to the transistor 102*a* thereby turning off the same. In this case, the storage capacitor 102*e* holds the voltage (pixel potential (Pix)) in response to the video signal for a constant period. Thus, the liquid crystal 102*d* is continuously supplied with the voltage in response to the video signal for the constant period.

In general, however, the n-type MOS field-effect transistor employed for constituting the pixel must be brought into an LDD (lightly doped drain) structure, in order to relax an internal field. Therefore, the number of ion implantation processes as well as that of ion implantation masks are increased to disadvantageously complicate a manufacturing process for the liquid crystal display and increase the manufacturing cost.

In order to avoid this problem, the pixel of the display may conceivably be constituted of a p-type MOS field-effect transistor. In this case, the p-type MOS field-effect transistor may not be brought into an LDD structure dissimilarly to the n-type MOS field-effect transistor, and hence the manufacturing process can be simplified and the manufacturing cost can be reduced.

When the p-type MOS field-effect transistor is employed for constituting the pixel of the display, however, the pixel potential disadvantageously fluctuates due to a larger leakage current than that in the n-type MOS field-effect transistor. It is believed that the p-type MOS field-effect transistor has a large leakage current due to tunneling through a trap level in the vicinity of the drain thereof. Consequently, it is difficult to hold the pixel potential (Pix) at the level in response to the video signal, disadvantageously leading to difficulty in displaying images with brightness in response to the video signal.

SUMMARY OF THE INVENTION

The present invention has been proposed in order to provide a display capable of correctly displaying images with brightness in response to a video signal.

The present invention has also been proposed in order to provide a semiconductor device capable of suppressing a leakage current.

In order to attain the aforementioned objects, a display according to a first aspect of the present invention comprises a gate line, a drain line arranged to intersect with the gate line and a pixel including a p-type first field-effect transistor provided with a gate connected to the gate line as well as a source and a drain, either one of which is connected to the drain line, and subjected to application of a first bias voltage in the period of an operation of holding a pixel potential and a pixel electrode connected to the other one of the source and the drain of the p-type first field-effect transistor, and applies a second bias voltage larger than the first bias voltage to the p-type first field-effect transistor of the pixel in a prescribed period other than the period of the operation of holding the pixel potential.

The display according to the first aspect applies the second bias voltage larger than the first bias voltage to the p-type first field-effect transistor of the pixel in the prescribed period other than the period of the operation of holding the pixel potential so that a trap level in the vicinity of the drain of the p-type first field-effect transistor disappears or the trap level captures carriers (holes), whereby the carriers are conceivably inhibited from tunneling through the trap level. Thus, the p-type first field-effect transistor is inhibited from a leakage current, whereby the pixel potential can be inhibited from fluctuation resulting from a leakage current in the period of the operation of holding the pixel potential. Consequently, the display can hold the pixel potential at the level in response to the video signal, thereby correctly displaying images with brightness in response to the video signal.

A semiconductor device according to a second aspect of the present invention comprises a p-type field-effect transistor including an active layer, consisting of polycrystalline silicon, having a gate, a source and a drain so that a first bias voltage is applied between the gate and the source and between the drain and the source in an OFF state in a normal operation, and applies a second bias voltage larger than the first bias voltage to the p-type field-effect transistor in a period other than the normal operation.

The semiconductor device according to the second aspect applies the second bias voltage larger than the first bias voltage to the p-type field-effect transistor in the period other than the normal operation so that a trap level in the vicinity of the drain of the p-type field-effect transistor disappears or the trap level captures carriers (holes), whereby the carriers are conceivably inhibited from tunneling through the trap level. Thus, the p-type field-effect transistor can be inhibited from a leakage current.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

The structure of a liquid crystal display according to a first embodiment of the present invention is described with reference to FIG. 1.

Figure 1:
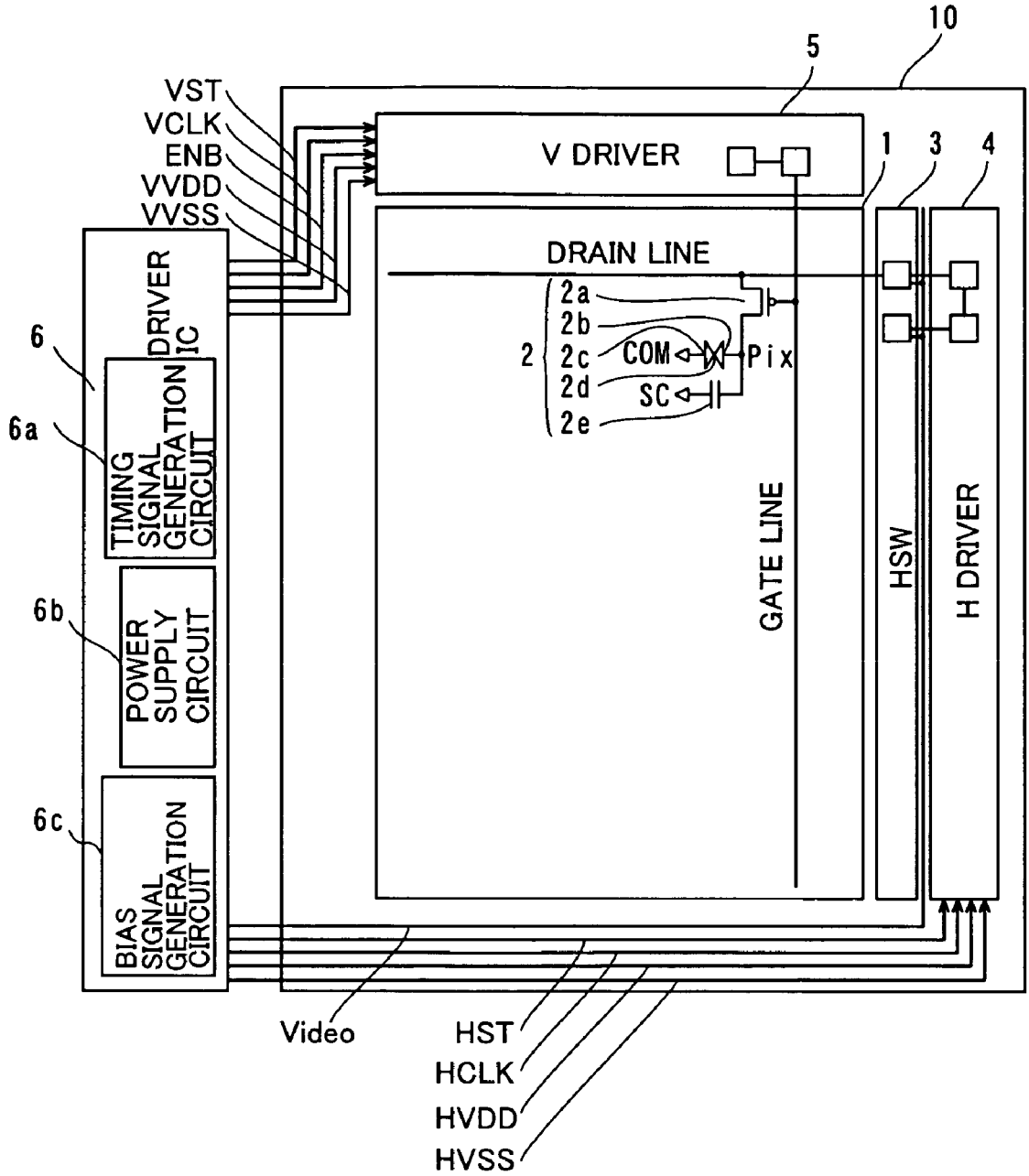
FIG. 1 is a plan view showing a liquid crystal display according to a first embodiment of the present invention.

In the liquid crystal display according to the first embodiment, a display part 1, a horizontal switch (HSW) 3, an H driver 4 and a V driver 5 are formed on a substrate 10, as shown in FIG. 1. The horizontal switch 3 and the H driver 4 are provided for driving (scanning) drain lines, while the V driver 5 is provided for driving (scanning) gate lines.

Pixels 2 are arranged on the display part 1 in the form of a matrix. FIG. 1 illustrates a structure for one pixel 2. Each pixel 2 includes a p-channel transistor 2*a* constituted of a thin-film transistor (TFT) having an active layer (not shown) consisting of polycrystalline silicon, a pixel electrode 2*b*, a common electrode 2*c*, common to each pixel 2, arranged oppositely to the pixel electrode 2*b*, a liquid crystal 2*d* held between the pixel electrode 2*b* and the common electrode 2*c* and a storage capacitor 2*e*. The p-channel transistor 2*a* is an example of the "p-type first field-effect transistor" in the present invention. One of the source and the drain of the p-channel transistor 2*a* is connected to a drain line. The other one of the source and the drain of the p-channel transistor 2*a* is connected to a first electrode of the storage capacitor 2*e* as well as to the pixel electrode 2*b* holding the liquid crystal 2*d* along with the common electrode 2*c*. The gate of this p-channel transistor 2*a* is connected to a gate line. In the period of an operation of holding a pixel potential (Pix) of the pixel electrode 2*b*, the liquid crystal display applies a first bias voltage consisting of a prescribed first gate-to-source voltage Vgs1 (about 3 V, for example) and a prescribed first drain-to-source voltage Vds1 (about −7 V, for example) to the p-channel transistor 2*a*.

A driver IC 6 including a Timing signal generation circuit 6*a*, a power supply circuit 6*b* and a bias application signal generation circuit 6*c* is set outside the substrate 10. The Timing signal generation circuit 6*a* is provided with a circuit for generating start signals HST and VST, clock signals HCLK and VCLK and an enable signal ENB. Thus, the driver IC 6 supplies the start signal HST and the clock signal HCLK to the H driver 4 while supplying the start signal VST, the clock signal VCLK and the enable signal ENB to the V driver 5. The driver IC 6 also supplies a video signal Video.

The power supply circuit 6*b* is provided with a circuit for generating a higher voltage VDD (about 8 V, for example) and a lower voltage VSS (about −4 V, for example). Thus, the driver IC 6 supplies a higher voltage HVDD (VDD) and a lower voltage HVSS (VSS) to the H driver 4 while supplying a higher voltage VVDD (VDD) and a lower voltage VVSS (VSS) to the V driver 5. The driver IC 6 further supplies a prescribed voltage to the common electrode (COM electrode) 2*c* holding the liquid crystal 2*d* constituting the pixel 2 of the display part 1 along with the pixel electrode 2*b* and a second electrode (SC electrode) of the storage capacitor 2*e*.

According to the first embodiment, the bias application signal generation circuit 6*c* is provided for applying a second bias voltage larger than the aforementioned first bias voltage to the p-channel transistor 2*a*. This second bias voltage includes a second gate-to-source voltage Vgs2 larger than the first gate-to-source voltage Vgs1 and a second drain-to-source voltage Vds2 larger than the first drain-to-source voltage Vds1. More specifically, the bias application signal generation circuit 6*c* generates a timing signal supplied to the gate line, the drain line, the COM electrode and the SC electrode in a bias application mode for applying the second bias voltage described later.

Figure 2:
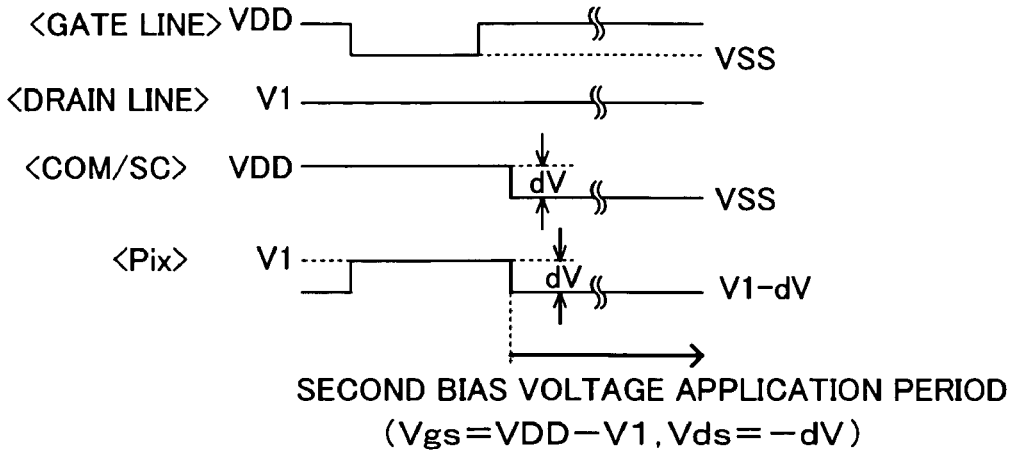
FIG. 2 is a timing chart for illustrating an operation of applying a second bias voltage to a p-channel transistor constituting a pixel of the liquid crystal display according to the first embodiment shown in FIG. 1.

Operations of the liquid crystal display according to the first embodiment are now described with reference to FIGS. 1 and 2.

Referring to FIG. 1, the liquid crystal display according to the first embodiment turns on the p-channel transistor 2*a* and supplies a prescribed video signal to the drain line in a normal operation (normal mode). Thus, the video signal is supplied to the pixel electrode 2*b* through the p-channel transistor 2*a*, thereby driving the liquid crystal 2*d*. At this time, the liquid crystal display charges the storage capacitor 2*e* with a voltage in response to the video signal. Thereafter the liquid crystal display turns off the p-channel transistor 2*a*. At this time, the liquid crystal display applies the first bias voltage consisting of the prescribed first gate-to-source voltage Vgs1 (about 3 V, for example) and the prescribed first drain-to-source voltage Vds1 (about −7 V, for example) to the OFF-state p-channel transistor 2*a*. In this case, the storage capacitor 2*e* holds the voltage (pixel potential (Pix)) in response to the video signal for a constant period. Thus, the liquid crystal 2*d* is continuously supplied with the voltage in response to the video signal for the constant period.

The operation of the bias application mode for applying the second bias voltage larger than the first bias voltage to the p-channel transistor 2*a* constituting the pixel 2 of the liquid crystal display according to the first embodiment is now described. In the bias application mode, the liquid crystal display according to the first embodiment changes the potentials of the COM electrode and the SC electrode by prescribed levels while holding the voltages of the gate line and the drain line at constant potentials, thereby applying the second bias voltage to the p-channel transistor 2*a*. More specifically, the signal supplied to the gate line lowers from VDD (high level) to VSS (low level), thereby turning on the p-channel transistor 2*a*. At this time, the liquid crystal display holds the signal supplied to the drain line at a potential V1 (0 V, for example) while holding the signal supplied to the COM electrode and the SC electrode at VDD. Thus, the pixel potential (Pix) builds up to the potential level V1 through the p-channel transistor 2*a*. Thereafter the signal supplied to the gate line rises to VDD (high level) thereby turning off the p-channel transistor 2*a*, and hence the pixel potential (Pix) is held at the level V1 due to the function of the storage capacitor 2*e*.

According to the first embodiment, the bias application signal generation circuit 6*c* controls the signal supplied from the power supply circuit 6*b* to the COM electrode and the SC electrode to lower from VDD to VSS. In other words, the signal supplied from the power supply circuit 6*b* to the COM electrode and the SC electrode lowers by a potential VDD−VSS=dV (about 12 V). Thus, the pixel potential (Pix) also lowers by the level dV, to reach a level V1−dV (=about −12 V). Consequently, the second gate-to-source voltage Vgs2 reaches a level VDD−V1 (=about 8 V) while the second drain-to-source voltage Vds2 reaches a level V1−dV−V1=−dV (about −12 V). The liquid crystal display applies the second gate-to-source voltage Vgs2 (=VDD−V1) and the second drain-to-source voltage Vds2 (=−dV) to the p-channel transistor 2*a* as the aforementioned second bias voltage.

When the liquid crystal display applies the second bias voltage constituted of the second gate-to-source voltage Vgs2 (=about 8 V) and the second drain-to-source voltage Vds2 (=about −12 V) to the p-channel transistor 2*a*, a leakage current of the p-channel transistor 2*a* is so increased that the pixel potential (Pix) of the level V1−dV starts to build up toward the level V1 due to the leakage current between the drain and the source of the p-channel transistor 2*a*. Therefore, the second drain-to-source voltage Vds2 (=−dV) constituting the second bias voltage applied to the p-channel transistor 2*a* is reduced. Thus, it is difficult to apply the second bias voltage to the p-channel transistor 2*a* for a sufficient period through a single bias application mode. According to the first embodiment, therefore, the liquid crystal display repeats the aforementioned bias application mode of applying the second bias voltage to the p-channel transistor 2*a* five times at intervals of about 3 ms. The liquid crystal display according to the first embodiment operates in the bias application mode when supplied with power.

According to the first embodiment, as hereinabove described, the liquid crystal display supplied with power applies the second bias voltage larger than the first bias voltage applied in the period of the operation of holding the pixel potential (Pix) to the p-channel transistor 2*a* so that a trap level in the vicinity of the drain of the p-channel transistor 2*a* disappears or captures carriers (holes), whereby the carriers are conceivably inhibited from tunneling through the trap level. Thus, the p-channel transistor 2*a* is inhibited from a leakage current so that the pixel potential (Pix) can be inhibited from fluctuation resulting from a leakage current in the period of the operation of holding the pixel potential (Pix). Consequently, the liquid crystal display can hold the pixel potential (Pix) at the level in response to the video signal, thereby correctly displaying images with brightness in response to the video signal.

According to the first embodiment, the second gate-to-source voltage Vgs2 constituting the second bias voltage is larger than the first gate-to-source voltage Vgs1 while the second drain-to-source voltage Vds2 also constituting the second bias voltage is larger than the first drain-to-source voltage Vds1, whereby the second bias voltage can be easily set larger than the first bias voltage. Thus, the liquid crystal display can easily apply the second bias voltage larger than the first bias voltage to the p-channel transistor 2*a*.

According to the first embodiment, the bias application signal generation circuit 6*c* controls the signal supplied from the power supply circuit 6*b* to the COM electrode and the SC electrode to lower from VDD to VSS, whereby the second drain-to-source voltage Vds2 constituting the second bias voltage can be easily set larger than the first drain-to-source voltage Vds1.

Further, the liquid crystal display according to the first embodiment changing the pixel potential (Pix) from VDD (about 8 V) to the level V1−dV (about −12 V) while holding the potential of the drain line at the level V1 (about 0 V) thereby applying the second bias voltage (Vgs2 (=about 8 V)+Vds2 (=about −12 V)) larger than the first bias voltage (Vgs1 (=about 3 V)+Vds1 (=about −7 V)) to the p-channel transistor 2*a* can reduce a leakage current flowing from the drain line toward the pixel electrode 2*b* in the period of the operation of holding the pixel potential.

The liquid crystal display according to the present invention, repeating the bias application mode of applying the second bias voltage to the p-channel transistor 2*a* five times at the intervals of about 3 ms can apply the second bias voltage to the p-channel transistor 2*a* for a period sufficient for reducing a leakage current also when the applied second bias voltage fluctuates due to the leakage current.

According to the first embodiment, the p-channel transistor 2*a* is constituted of the thin-film transistor (TFT) including the active layer consisting of polycrystalline silicon developing a larger quantity of leakage current as compared with a transistor including an active layer consisting of single-crystalline silicon, whereby the p-channel transistor 2*a* can be particularly effectively inhibited from a leakage current.

According to the first embodiment, the signal supplied to the drain line in the bias application mode is at the same level as a normal low-level video signal, whereby the liquid crystal display can supply the signal to the drain in the bias application mode within the range of a signal voltage employed for the normal operation. Thus, the liquid crystal display can easily generate the signal supplied to the drain line in the bias application mode.

Figure 3:
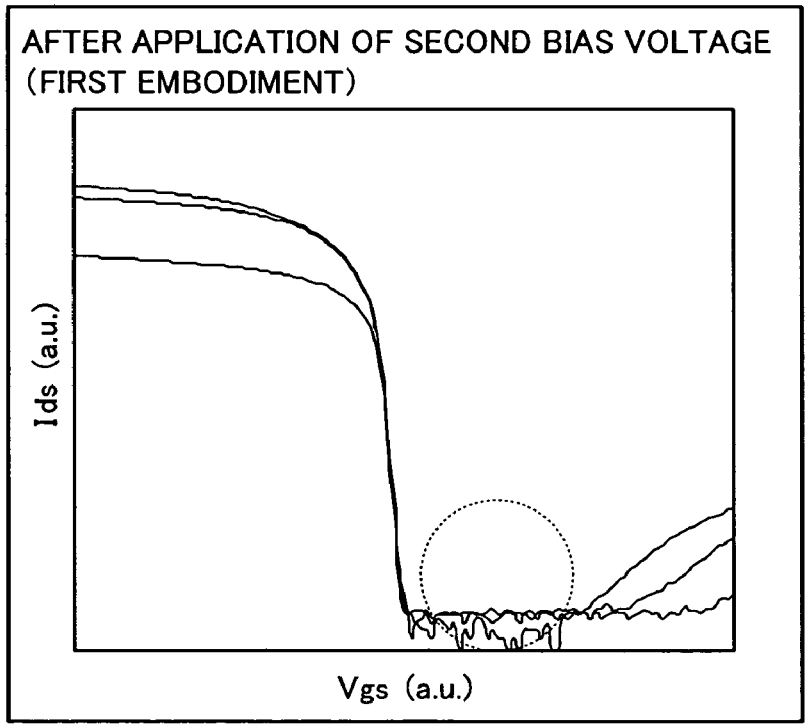
FIG. 3 is an Ids-Vgs characteristic diagram of the p-channel transistor subjected to application of the second bias voltage according to the first embodiment.
Figure 4:
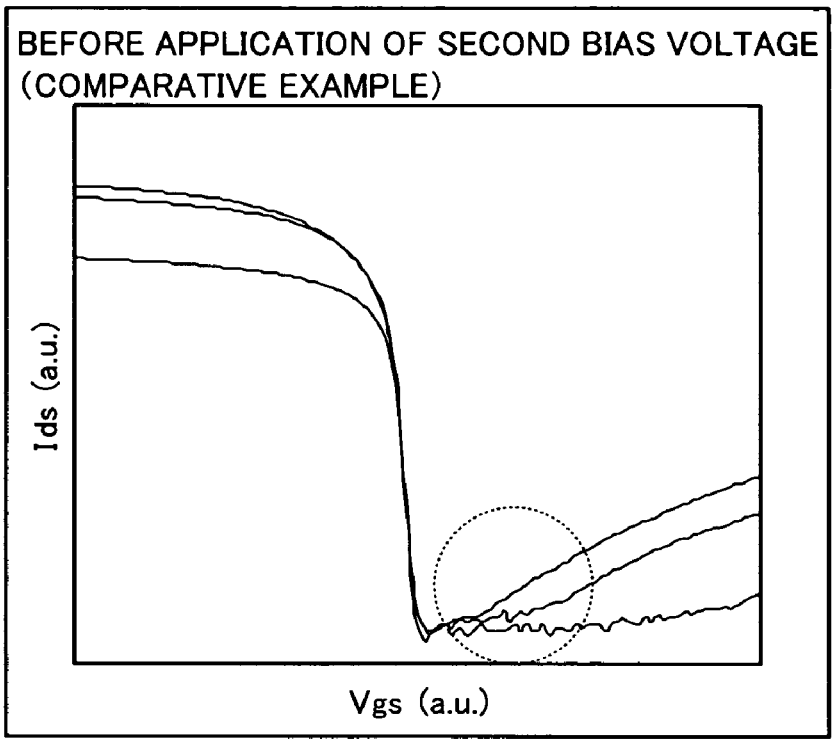
FIG. 4 is an Ids-Vgs characteristic diagram of a comparative p-channel transistor subjected to application of no second bias voltage.

A comparative experiment made for confirming the effects of the aforementioned first embodiment is now described. FIG. 3 is an Ids-Vgs characteristic diagram of a p-channel transistor subjected to application of the second bias voltage according to the first embodiment, and FIG. 4 is an Ids-Vgs characteristic diagram of a comparative p-channel transistor subjected to application of no second bias voltage. Referring to FIGS. 3 an 4, leakage currents were measured in the p-channel transistor subjected to application of the second bias voltage according to the first embodiment and the comparative p-channel transistor subjected to application of no second bias voltage respectively in this comparative experiment.

In regions (regions in OFF states of the p-channel transistors) enclosed with broken lines in FIGS. 3 and 4, the p-channel transistor subjected to application of the second bias voltage (FIG. 3) exhibited a small leakage current while the p-channel transistor subjected to application of no second bias voltage (FIG. 4) exhibited a large leakage current. Thus, it has been possible to confirm that the quantity of the leakage current was reduced in the p-channel transistor subjected to application of the second bias voltage as compared with the p-channel transistor subjected to application of no second bias voltage.

Second Embodiment

Figure 5:
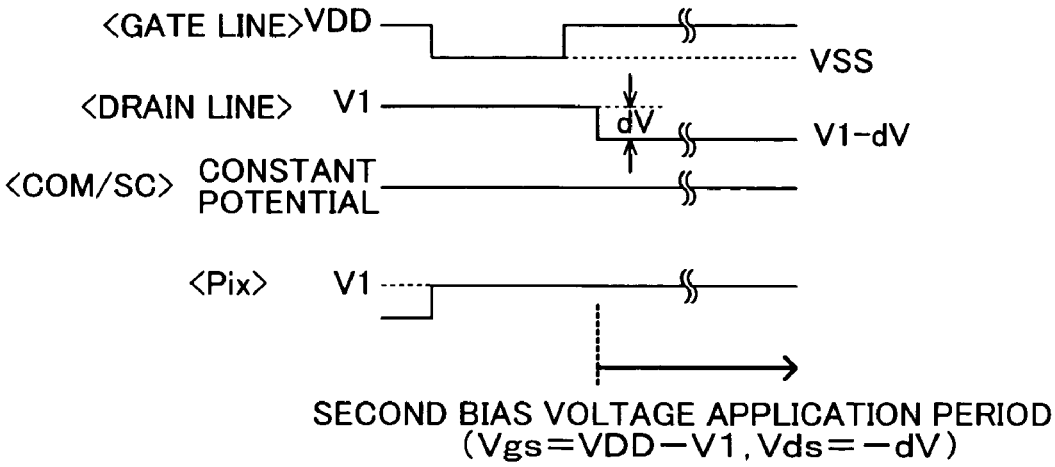
FIG. 5 is a timing chart for illustrating an operation of applying a second bias voltage to a p-channel transistor constituting a pixel of a liquid crystal display according to a second embodiment of the present invention.

Referring to FIGS. 1 and 5, a liquid crystal display according to a second embodiment of the present invention changes the potential of a drain line by a prescribed level while holding a gate line, a COM electrode and an SC electrode at constant potentials thereby applying a second bias voltage to a p-channel transistor 2*a* in a bias application mode, dissimilarly to the aforementioned first embodiment. The remaining structure of the second embodiment is similar to that of the aforementioned first embodiment.

In the bias application mode of the liquid crystal display according to the second embodiment, a signal supplied to the gate line lowers from VDD (high level) to VSS (low level), thereby turning on the p-channel transistor 2*a*. At this time, the liquid crystal display holds a signal supplied to the drain line at a level V1 (0 V, for example) while holding a signal supplied to the COM electrode and the SC electrode at a constant level. Thus, a pixel potential (Pix) builds up to the level V1 through the p-channel transistor 2*a*. Thereafter the signal supplied to the gate line rises to VDD (high level) thereby turning off the p-channel transistor 2*a*, and hence the pixel potential (Pix) is held at the level V1 due to the function of a storage capacitor 2*e*.

According to the second embodiment, the liquid crystal display controls the signal supplied to the drain line to lower by a level dV (about 10 V, for example). Thus, the signal supplied to the drain line reaches a level V1−dV (=about −10 V). Consequently, a second gate-to-source voltage Vgs2 reaches a level VDD−V1 (=about 8 V), while a second drain-to-source voltage Vds2 reaches a level V1−dV−V1=−dV (about −10 V). The liquid crystal display applies the second gate-to-source voltage Vgs2 (=VDD−V1) and the second drain-to-source voltage Vds2 (=−dV) to the p-channel transistor 2*a* as the second bias voltage, similarly to the aforementioned first embodiment. According to the second embodiment, further, the liquid crystal display repeats the bias application mode of applying the second bias voltage to the p-channel transistor 2*a* five times at intervals of about 3 ms. In the bias application mode according to the second embodiment, the liquid crystal display supplies a constant voltage such as VDD or VSS to the SC electrode.

In the bias application mode according to the second embodiment, the liquid crystal-display must supply a signal (about −10 V) having a lower potential than a normal video signal of a low level to the drain line. Therefore, the liquid crystal display according to the second embodiment, capable of easily applying a voltage other than that in a normal operation range to the drain line, preferably operates in the bias application mode before shipment.

According to the second embodiment, as hereinabove described, the liquid crystal display controlling the signal supplied to the drain line to lower by the level dV can easily set the second drain-to-source voltage Vds2 constituting the second bias voltage lower than a first drain-to-source voltage Vds1.

Further, the liquid crystal display according to the second embodiment holding the pixel potential (Pix) at the level V1 (about 0 V) while changing the potential of the drain line from the level V1 (about 0 V) to the level V1−dV (about −10 V) thereby applying the second bias voltage (Vgs2 (=about 8 V)+Vds2 (=about −10 V)) larger than a first bias voltage (Vgs1 (=about 3 V)+Vds1=(about −7 V)) to the p-channel transistor 2*a* can reduce a leakage current flowing from the pixel electrode 2*b* toward the drain line in the period of an operation of holding the pixel potential.

The remaining effects of the second embodiment are similar to those of the aforementioned first embodiment.

Third Embodiment

Figure 6:
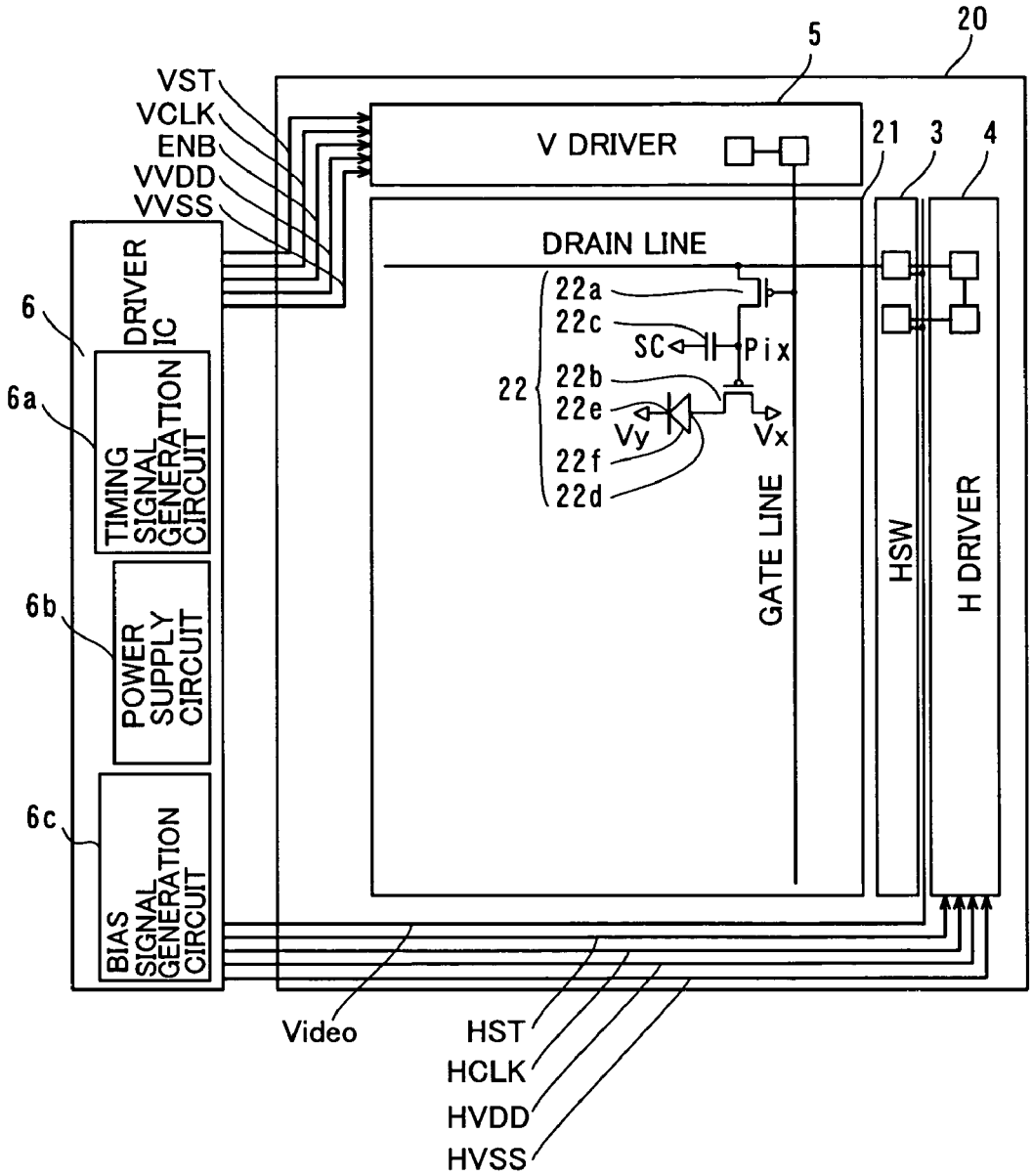
FIG. 6 is a plan view showing an organic EL display according to a third embodiment of the present invention.

Referring to FIG. 6, a third embodiment of the present invention is applied to an organic EL display.

In the organic EL display according to the third embodiment, a display part 21 is formed on a substrate 20, as shown in FIG. 6. Pixels 22 are arranged on the display part 21 in the form of a matrix. FIG. 6 shows a structure for one pixel 22 of the display part 21. Each pixel 22 includes p-channel transistors 22*a* and 22*b* constituted of thin-film transistors (TFTs) having active layers (not shown) consisting of polycrystalline silicon, a storage capacitor 22*c*, an anode 22d, a cathode 22*e* and an organic EL element 22*f* held between the anode 22*d* and the cathode 22*e*. The p-channel transistor 22*a* is an example of the "p-type first field-effect transistor" in the present invention, and the p-channel transistor 22*b* is an example of the "p-type second field-effect transistor" in the present invention. The organic EL element 22*f* is an example of the "light-emitting device" in the present invention. One of the source and the drain of the p-channel transistor 22*a* is connected to a drain line. The other one of the source and the drain of the p-channel transistor 22*a* is connected to a first electrode of the storage capacitor 22C as well as to a gate electrode of the p-channel transistor 22*b*. In the organic EL display according to the third embodiment, the electrodes (the first electrode of the storage capacitor 22*c* and the gate electrode of the p-channel transistor 22*b*) connected with the other one of the source and the drain of the p-channel transistor 22*a* correspond to the "pixel electrode" in the present invention. The gate of the p-channel transistor 22*a* is connected to a gate line. In the period of an operation of holding a pixel potential (Pix) of the gate electrode of the p-channel transistor 22*b*, the organic EL display applies a first bias voltage consisting of a prescribed first gate-to-source voltage Vgs1 (about 3 V, for example) and a prescribed first drain-to-source voltage Vds1 (about −7 V, for example) to the p-channel transistor 22*a*, similarly to the aforementioned embodiment.

The cathode 22*e* of the organic EL element 22*f* is connected to a first potential Vy, while the anode 22*d* is connected to one of the source and the drain of the p-channel transistor 22*b*. The other one of the source and the drain of the p-channel transistor 22*b* is connected to a second potential Vx. The prescribed potential Vy is an example of the "first potential" in the present invention, and the other prescribed potential Vx is an example of the "second potential" in the present invention.

The remaining structure of the third embodiment is similar to that of the aforementioned first embodiment.

Figure 7:
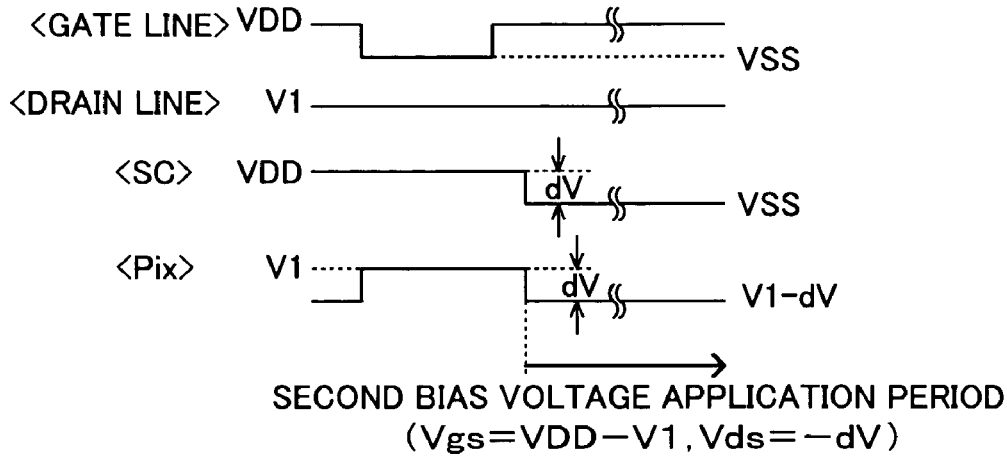
FIG. 7 is a timing chart for illustrating an operation of applying a second bias voltage to a p-channel transistor constituting a pixel of the organic EL display according to the third embodiment shown in FIG. 6.

Operations of the organic EL display according to the third embodiment are now described with reference to FIGS. 6 and 7.

Referring to FIG. 6, the organic EL display according to the third embodiment turns on the p-channel transistor 22*a* and supplies a prescribed video signal to the drain line in a normal operation (normal mode). The video signal is supplied to the gate electrode of the p-channel transistor 22*b* through the p-channel transistor 22*a*, thereby turning on the p-channel transistor 22*b*. Thus, the organic EL element 22*f* is supplied with a current for emitting light with brightness in response to the video signal supplied to the gate electrode of the p-channel transistor 22*b*. At this time, the organic EL display charges the storage capacitor 22*c* with a voltage in response to the video signal. Thereafter the organic EL display turns off the p-channel transistor 22*a*. At this time, the organic EL display applies the first bias voltage consisting of the prescribed first gate-to-source voltage Vgs1 (about 3 V, for example) and the prescribed first drain-to-source voltage Vds1 (about −7 V, for example) to the OFF-state p-channel transistor 22*a*. In this case, the storage capacitor 22*c* holds the voltage (the pixel potential (Pix)) in response to the video signal for a constant period. Thus, the gate electrode of the p-channel transistor 22*b* is continuously supplied with the voltage in response to the video signal, so that the organic EL element 22*f* emits light for the constant period with the brightness in response to the video signal.

An operation of a bias application mode for applying a second bias voltage larger than the first bias voltage to the p-channel transistor 22*a* constituting the pixel 22 of the organic EL display according to the third embodiment is now described. In the bias application mode, the organic EL display performs an operation similar to that in the bias application mode of the liquid crystal display according to the first embodiment shown in FIG. 2. In other words, the organic EL display changes the potential of an SC electrode by a prescribed level while holding the voltages of the gate line and the drain line at constant levels, thereby applying the second bias voltage to the p-channel transistor 22*a*. Thus, a second gate-to-source Vgs2 reaches a level VDD−V1 (=about 8 V) and a second drain-to-source voltage Vds2 reaches a level V1−dV−V1=−dV (about −12 V), similarly to the aforementioned first embodiment. The organic EL display repeats the aforementioned bias application mode of applying the second bias voltage to the p-channel transistor 22*a* five times at intervals of about 3 mn.

The organic EL display according to the third embodiment of the present invention controls first and second potentials Vy and Vx to be substantially identical to each other when applying the second bias voltage to the p-channel transistor 22*a*.

According to the third embodiment having the aforementioned structure, the organic EL display capable of suppressing a leakage current flowing from the drain line toward the gate electrode of the p-channel transistor 22*b* in the period of the operation of holding the pixel potential can also correctly display images with brightness in response to the video signal.

Further, the organic EL display according to the third embodiment, controlling the first and second potentials Vy and Vx to be substantially identical to each other for turning off the p-channel transistor 22*b* when applying the second bias voltage to the p-channel transistor 22*a*, can prevent the p-channel transistor 22*b* from serving as a capacitor. Thus, the organic EL display can inhibit insufficient bias application to the p-channel transistor 22*a* resulting from a capacitive component of the p-channel transistor 22*b*. Further, the organic EL display supplying no current to the organic EL element 22*f* can prevent the organic EL element 22*f* from emitting light when applying the second bias voltage.

Fourth Embodiment

Figure 8:
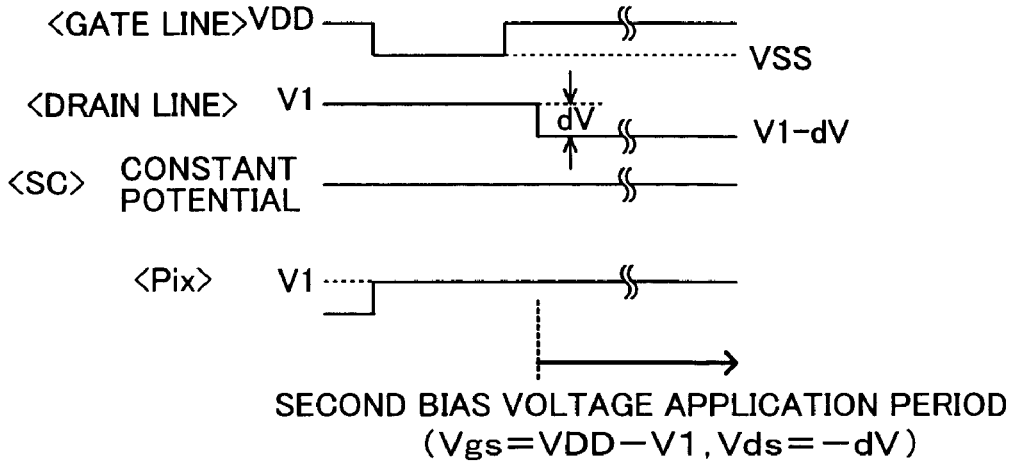
FIG. 8 is a timing chart for illustrating an operation of applying a second bias voltage to a p-channel transistor constituting a pixel of an organic EL display according to a fourth embodiment of the present invention.
Figure 9:
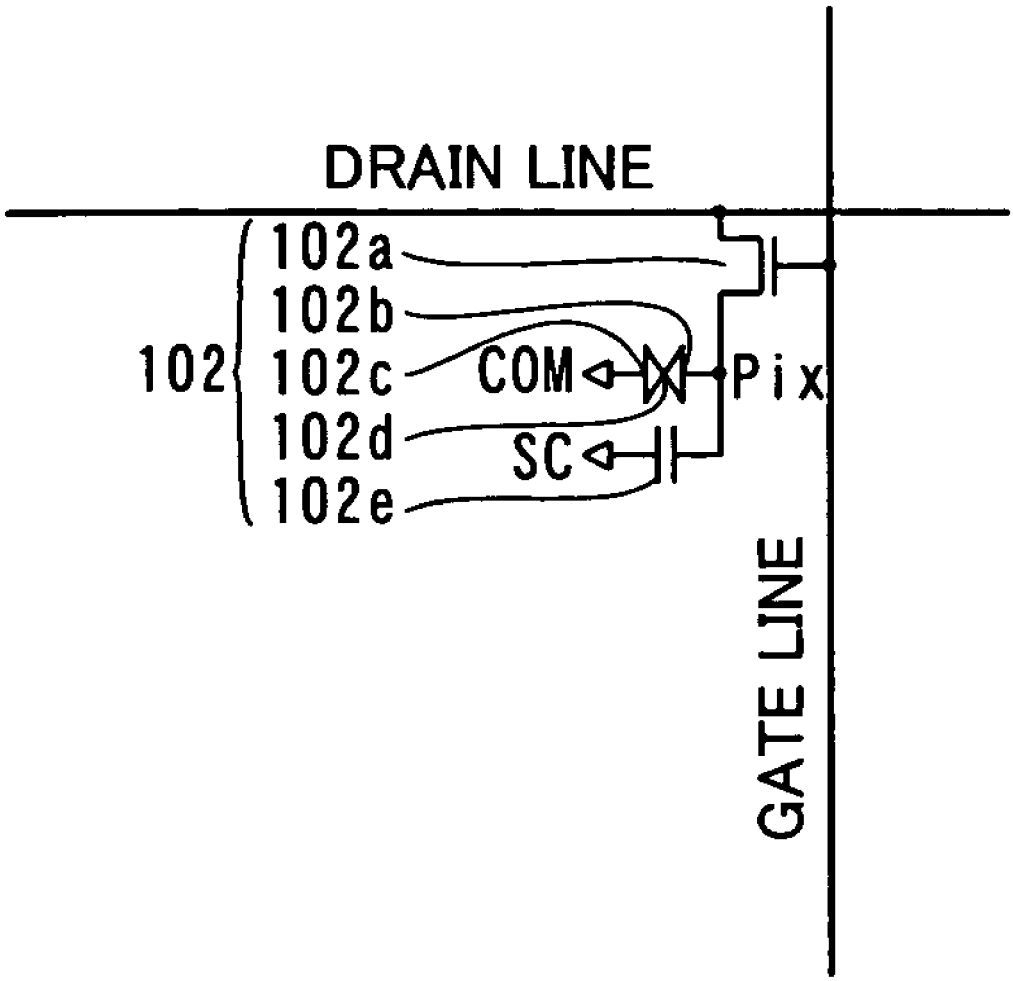
FIG.9 PRIOR ART
FIG. 9 is a circuit diagram showing a pixel of an exemplary conventional liquid crystal display.

Referring to FIGS. 6 and 8, an organic EL display according to a fourth embodiment of the present invention performs an operation similar to that in the bias application mode of the liquid crystal display according to the second embodiment shown in FIG. 5 in a bias applying mode, dissimilarly to the aforementioned third embodiment. In other words, the organic EL display according to the fourth embodiment changes the potential of a drain line by a prescribed level while holding a gate line and an SC electrode at constant potentials thereby applying a second bias voltage to a p-channel transistor 22*a*. Thus, a second gate-to-source voltage Vgs2 reaches a level VDD−V1 (=about 8 V) while a second drain-to-source voltage Vds2 reaches a level V1−dV−V1=−dV (about −10 V), similarly to the aforementioned second embodiment. Further, the organic EL display repeats the aforementioned bias application mode of applying the second bias voltage to the p-channel transistor 22*a* five times at intervals of about 3 ms. In the bias application mode according to the fourth embodiment, the organic EL display supplies a constant voltage such as VDD or VSS to the SC electrode, similarly to the aforementioned second embodiment. At this time, the organic EL display controls first and second potentials Vy and Vx to be substantially identical to each other, similarly to the aforementioned third embodiment.

According to the fourth embodiment having the aforementioned structure, the organic EL display capable of suppressing a leakage current flowing from the gate electrode of a p-channel transistor 22*b* toward the drain line in the period of an operation of holding a pixel potential can also correctly display images with brightness in response to a video signal.

The remaining effects of the fourth embodiment are similar to those of the aforementioned third embodiment.

Although the present invention has been described and illustrated in detail, it is clearly understood that the same is by way of illustration and example only and is not to be taken by way of limitation, the spirit and scope of the present invention being limited only by the terms of the appended claims.

For example, the present invention is not restricted to the aforementioned first to fourth embodiments but is also applicable to reduction of a leakage current in a semiconductor device including a p-type field-effect transistor consisting of a TFT including an active layer consisting of polycrystalline silicon. In other words, the leakage current of the p-type first field-effect transistor can be suppressed by applying a second bias voltage larger than a first bias voltage applied between the gate and the source and between the drain and the source in an OFF state in a normal operation, similarly to the aforementioned first to fourth embodiments.

The present invention is not restricted to the aforementioned first to fourth embodiments, but a potential other than VDD or VSS may alternatively be employed.

The present invention is not restricted to the aforementioned first to fourth embodiments but is also applicable to a display such as an inorganic EL display, for example, other than a liquid crystal display and an organic EL display.

The present invention is not restricted to the aforementioned first to third embodiments but the second bias voltage may alternatively be applied before shipment.

The present invention is not restricted to the aforementioned first to third embodiments but the pixel potential may alternatively be controlled through another control means other than the bias application signal generation circuit.

What is claimed is:

1. A display comprising:

a gate line;

a drain line arranged to intersect with said gate line; and a pixel including a p-type first field-effect transistor provided with a gate connected to said gate line as well as a source and a drain, either one of which is connected to said drain line, and subjected to application of a first bias voltage in the period of an operation of holding a pixel potential and a pixel electrode connected to the other one of said source and said drain of said p-type first field-effect transistor, the display applying a second bias voltage larger than said first bias voltage to said p-type first field-effect transistor of said pixel in a prescribed period other than the period of said operation of holding said pixel potential, and setting the potentials of said gate line and said drain line to prescribed potential levels respectively so that the potential difference between said gate line and said drain line reaches said second gate-to-source voltage while controlling the potential of said pixel electrode so that the potential difference between said drain line and said pixel electrode reaches said second drain-to-source voltage when applying said second bias voltage, wherein said first bias voltage includes a first gate-to-source voltage and a first drain-to-source voltage, and said second bias voltage includes a second gate-to-source voltage larger than said first gate-to-source voltage and a second drain-to-source voltage larger than said first drain-to-source voltage.

2. The display according to claim 1, controlling the potential of said pixel electrode to be lower than the potential of said drain line when applying said second bias voltage.

3. The display according to claim 1, further comprising a common electrode arranged oppositely to said pixel electrode, for controlling the potential of said pixel electrode to be lower than the potential of said drain line by changing the potential of said common electrode by a prescribed potential when applying said second bias voltage.

4. The display according to claim 1, wherein the potential of said drain line is within the range of the potential of a video signal for holding said pixel potential when said second bias voltage is applied.

5. A display comprising:

a gate line;

a drain line arranged to intersect with said gate line; and a pixel including a p-type first field-effect transistor provided with a gate connected to said gate line as well as a source and a drain, either one of which is connected to said drain line, and subjected to application of a first bias voltage in the period of an operation of holding a pixel potential and a pixel electrode connected to the other one of said source and said drain of said p-type first field-effect transistor, the display applying a second bias voltage larger than said first bias voltage to said p-type first field-effect transistor of said pixel in a prescribed period other than the period of said operation of holding said pixel potential, and setting the potentials of said gate line and said pixel electrode to prescribed potential levels respectively so that the potential difference between said gate line and said pixel electrode reaches said second gate-to-source voltage while controlling the potential of said drain line so that the potential difference between said pixel electrode and said drain line reaches said second drain-to-source voltage when applying said second bias voltage, wherein said first bias voltage includes a first gate-to-source voltage and a first drain-to-source voltage, and said second bias voltage includes a second gate-to-source voltage larger than said first gate-to-source voltage and a second drain-to-source voltage larger than said first drain-to-source voltage.

6. The display according to claim 5, controlling the potential of said drain line to be lower than the potential of said pixel electrode when applying said second bias voltage.

7. The display according to claim 1 or 5, applying said second bias voltage to said p-type first field-effect transistor a plurality of times.

8. The display according to claim 1 or 5, wherein said p-type first field-effect transistor is a thin-film transistor including an active layer consisting of polycrystalline silicon.

9. The display according to claim 1 or 5, wherein said pixel further includes a liquid crystal.

10. The display according to claim 1 or 5, wherein said pixel further includes a light-emitting device consisting of an organic material or an inorganic material.

11. The display according to claim 10, wherein said light-emitting device includes a first electrode connected to a first potential and a second electrode, and said pixel further includes a p-type second field-effect transistor having a gate connected to said pixel electrode as well as a source and a drain, either one of which is connected to said second electrode of said light-emitting device and the other one of said source and said drain is connected to a second potential, said display controlling said first potential and said second potential substantially to the same potential level when applying said second bias voltage to said p-type first field-effect transistor.

12. The display according to claim 1 or 5, further comprising a bias application signal generation circuit for applying a second bias voltage larger than said first bias voltage to said p-type first field-effect transistor.

* * * * *